US010717942B2

(12) United States Patent
Kawamoto et al.

(10) Patent No.: US 10,717,942 B2
(45) Date of Patent: Jul. 21, 2020

(54) LUBRICANT BASE OIL AND LUBRICATING OIL COMPOSITION

(71) Applicant: NOF CORPORATION, Tokyo (JP)

(72) Inventors: Hideki Kawamoto, Amagasaki (JP); Shunsuke Monjiyama, Amagasaki (JP)

(73) Assignee: NOF CORPORATION, Tokyo (JP)

( * ) Notice: Subject to any disclaimer, the term of this patent is extended or adjusted under 35 U.S.C. 154(b) by 0 days.

(21) Appl. No.: 16/308,930

(22) PCT Filed: Jun. 7, 2017

(86) PCT No.: PCT/JP2017/021113

§ 371 (c)(1),
(2) Date: Dec. 11, 2018

(87) PCT Pub. No.: WO2017/217295

PCT Pub. Date: Dec. 21, 2017

(65) Prior Publication Data

US 2019/0161695 A1 May 30, 2019

(30) Foreign Application Priority Data

Jun. 14, 2016 (JP) ..... 2016-118099

(51) Int. Cl.

| | |
|---|---|
| ***C10M 105/42*** | (2006.01) |
| ***C10M 169/04*** | (2006.01) |
| ***C10M 133/40*** | (2006.01) |
| ***C10M 105/22*** | (2006.01) |

(52) U.S. Cl.

CPC ..... *C10M 105/42* (2013.01); *C10M 105/22* (2013.01); *C10M 133/40* (2013.01); *C10M 169/04* (2013.01); *C10M 2207/026* (2013.01); *C10M 2207/2805* (2013.01); *C10M 2207/30* (2013.01); *C10M 2207/301* (2013.01); *C10M 2215/221* (2013.01); *C10M 2215/223* (2013.01); *C10M 2219/022* (2013.01); *C10N 2220/022* (2013.01); *C10N 2220/023* (2013.01); *C10N 2220/10* (2013.01); *C10N 2230/06* (2013.01); *C10N 2230/10* (2013.01); *C10N 2230/12* (2013.01); *C10N 2230/18* (2013.01); *C10N 2240/04* (2013.01); *C10N 2240/52* (2013.01)

(58) Field of Classification Search

CPC ..... C10M 2207/30; C10M 2215/221; C10M 2207/2805; C10N 2230/12; C10N 2230/10; C10N 2230/06

See application file for complete search history.

(56) References Cited

U.S. PATENT DOCUMENTS

| | | | | |
|---|---|---|---|---|
| 3,038,859 A * | 6/1962 | Eickemeyer | ..... | C10M 169/04 508/252 |
| 3,778,454 A * | 12/1973 | Kleinman et al. | ..... | C10M 3/00 554/227 |
| 2017/0002291 A1 * | 1/2017 | Takahashi | ..... | C10M 171/008 |

FOREIGN PATENT DOCUMENTS

| | | | |
|---|---|---|---|
| JP | 7-034080 | A | 2/1995 |
| JP | 2010-260972 | A | 11/2010 |
| JP | 2012-102235 | A | 5/2012 |
| JP | 2013-053227 | A | 3/2013 |

OTHER PUBLICATIONS

International Search Report for PCT/JP2017/021113 dated Jul. 11, 2017 [PCT/ISA/210].

* cited by examiner

*Primary Examiner* — Vishal V Vasisth
(74) *Attorney, Agent, or Firm* — Sughrue Mion, PLLC

(57) ABSTRACT

A lubricant base oil composed of an ester. The ester includes a component (A) derived from trimethylolpropane in a molar percentage $A_{mol\,\%}$ of 25 to 42 mol %; components (B) derived from monovalent straight-chain saturated fatty acids each having a carbon number of 8 to 12 in a molar percentage $B_{mol\,\%}$ of 33 to 55 mol %: and a component (C) derived from adipic acid in a molar ratio $C_{mol\,\%}$ of 12 to 34 mol %. The components (B) include lauric acid in a molar percentage of 5 to 50 mol %, and $(B_{COOH}+C_{COOH})/A_{OH}$ is 0.90 to 1.02. $A_{OH}$ represents a hydroxyl equivalent of the component (A), $B_{COOH}$ represents a carboxyl group equivalent of the components (B); and $C_{COOH}$ represents a carboxyl group equivalent of the component (C).

8 Claims, No Drawings

LUBRICANT BASE OIL AND LUBRICATING OIL COMPOSITION

CROSS REFERENCE TO RELATED APPLICATIONS

This application is a National Stage of International Application No. PCT/JP2017/021113 filed Jun. 7, 2017, claiming priority based on Japanese Patent Application No. 2016-118099 filed Jun. 14, 2016.

TECHNICAL FIELD

The present invention relates to a lubricant base oil superior in fluidity at a low temperature, biodegradability and lubricating property. The lubricant base oil of the present invention is suitable for use in a lubricating oil for industrial use such as a gear oil, chain oil or the like, and particularly suitable for use in a lubricating oil for a gear oil in a wind turbine generator system.

BACKGROUND ARTS

Recently, earth environmental problems have drawn attention. It has been thus demanded suppression of consumption of fossil fuels such as petroleum oil, coal or the like for preventing global warming. It has been thus demanded utilization of clean energies without discharging $CO_2$ in various countries. Wind turbine generation is known as one of the clean energies. According to the wind turbine generation, wings called blades are pressed by wind so that the blades are rotated. The rotation is then transmitted to a rate increaser (gear box) through a power transmission axis. The rotation rate is increased by the rate increaser so that the rotation is converted to electric power through a generator.

In the rate increaser, it is used a gear oil for lubricating a gear and for preventing the wearing. Generally, for the gear oil for use in the wind turbine generator, it is used a hydrocarbon-based base oil having a high viscosity and of a mineral oil or of polyolefin base.

Further, recently, it is developed a wind turbine generation system fixed on a sea. The wind turbine generation system on the sea is superior than that on a land in that the generation can be performed on the sea with strong and stabilized wind blown and in that it can be obtained an electric power larger than that obtained by the generation system on the land having the same scale. However, in the case that the gear oil is leaked in the wind turbine generation system on the sea, the leaked gear oil is easily flown into the sea. It is thus demanded that the gear oil has low load on the environment. However, the gear oil of hydrocarbon base with a high viscosity conventionally used has low biodegradability. It has been thus studied a gear oil having high biodegradability.

For example, according to patent document 1, it is disclosed a gear oil composition superior in biodegradability and comprising an acidic amine salt of a phosphoric acid and an ester base oil synthesized by a polyhydric alcohol, a saturated dicarboxylic acid and a saturated monocarboxylic acid.

Further, as the wind generation system is fixed on a place to which wind is easily blown, excellent low-temperature fluidity is also demanded so that the system can be operated in the case that the temperature of the oil is lowered. The excellent stability at a low temperature is not given to the gear oil composition of patent document 1.

As a technique for solving the object relating to the low-temperature fluidity described above, it is disclosed, in patent document 2, a biodegradable gear composition having excellent low-temperature fluidity. The biodegradable composition is composed of ester base oil synthesized by a polyhydric alcohol, a saturated dicarboxylic acid and a saturated monocarboxylic acid, an acidic amine salt of a phosphoric acid and a hindered polyol ester.

TECHNICAL DOCUMENTS

Patent Documents (Patent document 1) Japanese patent publication No. 2010-260972A
(Patent document 2) Japanese patent publication No. 2013-053227A

SUMMARY OF THE INVENTION

However, generally, it is possible to impart excellent extreme pressure performance to a gear composition by adding a sulfur-based extreme pressure additive. Although such kind of extreme pressure additive can impart the excellent extreme pressure performance to hydrocarbon-series base oil, it is known that sufficient extreme pressure performance cannot be obtained in an ester compound by adding such extreme pressure additive. High extreme pressure performance cannot thus be imparted even in the patent document 2 described above.

As such, in the gear oil for the wind turbine generation, it has not been proposed a lubricant base oil having high biodegradability, excellent low-temperature fluidity and extreme pressure performance upon adding an extreme pressure additive.

An object of the present invention is to provide a lubricant base oil having high biodegradability, excellent low-temperature fluidity and extreme pressure performance upon adding an extreme pressure additive.

The present inventors studied for solving the problems described above. It is thus found that it is possible to provide a lubricant base oil having good biodegradability, excellent low-temperature fluidity and excellent extreme pressure performance upon adding an extreme pressure additive, by providing an ester comprising trimethylolpropane, a monovalent straight-chain saturated fatty acid having a carbon number of 8 to 12 and adipic acid, in which the ester has a specific content of lauric acid, a carboxylic group equivalent and hydroxyl group equivalent.

That is, the present invention provides the followings (1) and (2).

(1) A lubricant base oil comprising an ester, said ester comprising:

a component (A) derived from trimethylolpropane in a molar percentage $A_{mol\ \%}$ of 25 to 42 mol %;

components (B) derived from monovalent straight-chain saturated fatty acids each having a carbon number of 8 to 12 in a molar percentage $B_{mol\ \%}$ of 33 to 55 mol %:

a component (C) derived from adipic acid in a molar ratio $C_{mol\ \%}$ of 12 to 34 mol %, wherein the components (B) derived from the monovalent straight-chain saturated fatty acids each comprise a component derived from lauric acid in a molar percentage of 5 to 50 mol %, and wherein $(B_{COOH}+C_{COOH})/A_{OH}$ is 0.90 to 1.02.

($A_{OH}$ represents a hydroxyl equivalent of the component (A) derived from trimethylolpropane, $B_{COOH}$ represents a carboxyl group equivalent of the components (B) derived from the monovalent straight-chain saturated fatty acids each having a carbon number of 8 to 12; and $C_{COOH}$ represents a carboxyl group equivalent of the component (C) derived from adipic acid.

(2) A lubricating oil composition comprising:

100 mass percent of the lubricant base oil of (1); and 0.1 to 3.0 mass percent of (D) a quinoline derivative.

The lubricant base oil of the present invention has high biodegradability, excellent low-temperature fluidity and extreme pressure performance upon adding an extreme pressure additive.

MODES FOR CARRYING OUT THE INVENTION

The lubricant base oil and lubricating oil composition of the present invention will be described below. Numeral ranges defined by using a symbol "~" in the specification is to include numerical values at both ends (upper and lower limits) of the numerical range defined by "~". For example, "2~5" means that not lower than 2 and not higher than 5.

The lubricant base oil of the present invention is a composite ester of (A) trimethylolpropane, (B) monovalent straight-chain saturated fatty acids each having a carbon number of 8 to 12 and (C) adipic acid.

Trimethylolpropane is used as an alcohol raw material of the ester of the present invention. As trimethylolpropane has a neopentyl bone structure, its stability against oxidation and thermal resistance are excellent, and a composite ester synthesized from trimethylolpropane has excellent low-temperature fluidity. As a polyhydric alcohol having neopentyl bone structure other than trimethylolpropane, it may be listed neopentyl glycol and pentaerythritol. However, a complex ester obtained from neopentyl glycol as a raw material has a high polarity, so that the effect of the additive may be deteriorated. Further, the pour point of a complex ester obtained from pentaerythritol as a raw material tends to be high, so that it is not suitable for applications in which it is to be used in cold climates. Trimethylolpropane is thus preferred according to the present invention.

(B) The monovalent straight-chain saturated fatty acids each having a carbon number of 8 to 12 means a monocarboxylic acid having 8 to 12 carbon atoms, having a straight-chain hydrocarbon chain and free from an unsaturated bond in the molecule. In the case that a monovalent straight-chain saturated fatty acid having a carbon number of less than 8, the thus obtained ester does not have sufficiently high extreme pressure performance upon adding an extreme pressure additive. In the case that it is used a monovalent straight-chain saturated fatty acid having a carbon number of more than 12, the low-temperature fluidity of the thus obtained ester is deteriorated. The monovalent straight-chain saturated fatty acids each having a carbon number of 8 to 12 used in the present invention includes caprylic acid, pelargonic acid, capric acid, undecylic acid and lauric acid.

According to the present invention, 5 to 50 mol % of lauric acid belonging to the monovalent straight-chain fatty acid having a carbon number of 12 is contained, provided that 100 mol % is assigned to a total content of the monovalent straight-chain saturated fatty acids each having carbon number of 8 to 12. Excellent extreme pressure performance and wear resistance can be obtained upon adding an extreme pressure additive, by containing 5 to 50 mol % of lauric acid. By adjusting the ratio of lauric acid within the range defined in the present invention, excellent low-temperature fluidity, extreme pressure performance and wear resistance can be obtained at good balance in the case that the gear oil is prepared. In the case that the ratio of lauric acid is below mol %, sufficiently high extreme pressure performance and wear resistance cannot be obtained. In the case that the ratio of lauric acid exceeds 50 mol %, good low-temperature fluidity cannot be obtained. On the viewpoints, the ratio of lauric acid may preferably be 10 to 45 mol % and more preferably be 15 to 40 mol %.

In the monovalent straight-chain saturated fatty acid having a carbon number of 8 to 12, the monovalent straight-chain saturated fatty acid other than lauric acid may be used alone or two or more acids may be used in combination. Other than lauric acid, combinations of two kinds of caprylic acid and pelargonic acid, caprylic acid and capric acid, caprylic acid, undecylic acid and the like are preferred, and the combination of caprylic acid and capric acid is more preferred. As described above, the ester of the present invention has excellent biodegradability, good low-temperature fluidity and exhibits excellent extreme pressure performance and wear resistance upon blending an extreme pressure additive, by containing a predetermined amount of lauric acid.

The molar percentage of lauric acid with respect to a total amount of monovalent straight-chain saturated fatty acids each having a carbon number of 8 to 12 can be analyzed by gas chromatography. For example, an ester (0.1 g) is diluted by a solvent mixture (5 g) of toluene and methanol having a mass ratio of 80/20, to which 28 mass percent of methanol solution of sodium methoxide (supplied by Wako Pure Chemical Industries, Ltd.) (0.3 g) is then added. The resultant solution was stand for 30 minutes at ambient temperature so that the ester is decomposed by methanolysis. The solution of the thus obtained decomposed product of the ester is analyzed by gas chromatography. Based on the thus obtained ratio of areas of peaks corresponding to the monovalent straight-chain saturated fatty acids each having a carbon number of 8 to 12 and lauric acid, it can be calculated the molar percentage of lauric acid with respect to the total amount of the monovalent-straight chain saturated fatty acids each having a carbon number of 8 to 12.

The diprotic acid as a material of the ester used in the present invention is (C) adipic acid. In the case that it is used succinic acid or the like whose carbon number is lower than that of adipic acid, the thus obtained ester has high polarity, so that it may be difficult to obtain the extreme pressure performance and wear resistance upon adding an extreme pressure additive. On the other hand, in the case that it is used a dimer acid whose carbon number is higher than that of adipic acid or maleic acid including a double bond, the resistance against oxidation or thermal resistance may be deteriorated. Based on the reasons described above, the diprotic acid used in the present invention is made adipic acid.

Further, the ester forming the lubricant base oil of the present invention includes a component (A) derived from trimethylolpropane in a molar percentage $A_{mol\ \%}$ of 25 to 42 mol %, components (B) derived from monovalent straight-chain saturated fatty acids each having a carbon number of 8 to 12 in a molar percentage $B_{mol\ \%}$ of 33 to 55 mol %, a component (C) derived from adipic acid in a molar ratio $C_{mol\ \%}$ of 12 to 34 mol %, and $(B_{COOH}+C_{COOH})/A_{OH}$ is 0.90 to 1.02.

($A_{OH}$ represents a hydroxyl equivalent of the component (A) derived from trimethylolpropane, $B_{COOH}$ represents a carboxyl group equivalent of the components (B) derived from the monovalent straight-chain saturated fatty acids each having a carbon number of 8 to 12; and $C_{COOH}$ represents a carboxyl group equivalent of the component (C) derived from adipic acid.)

$A_{mol\ \%}$%, $B_{mol\ \%}$, $C_{mol\ \%}$, $A_{OH}$, $B_{COOH}$ and $C_{COOH}$ are values calculated after molar ratios of the respective raw materials are obtained by $^1$H NMR.

The conditions for measurement of $^1$H NMR are as follows.

(Measurement Conditions)

Measuring apparatus: $^1$H NMR

Solvent: heavy chloroform

A $^1$H NMR chart of the ester obtained under the measurement conditions described above is analyzed so that the molar ratios can be calculated.

Specifically, the following four peaks are used.

Peak (I): 3.40~3.60 ppm;

(A) hydrogen atom on a position of unreacted hydroxyl group of trimethylolpropane Peak (II): 4.00~4.20 ppm;

(A) hydrogen atom on a position of reacted hydroxyl group of trimethylolpropane {Number of hydrogen atoms of the peak (I) and peak (II) is 6}

Peak (III): 0.85~0.90 ppm;

(B) hydrogen atoms (three) connected to terminal carbon atoms of the monovalent straight-chain saturated fatty acids each having a carbon number of 8 to 12, and hydrogen atoms (three) connected to carbon atom of (A) trimethylolpropane Peak (IV): 2.25~2.35 ppm; Hydrogen atoms (four) on a position of carbonyl group of (C) adipic acid, and hydrogen atoms (two) on a position of carbonyl group of (B) the monovalent straight-chain saturated fatty acids each having a carbon number of 8 to 12

The integrated values of the four peaks described above are calculated as follows to determine the molar percentages.

$$A_{mol}=\{\text{Integrated value of peak } (I)+\text{integrated value of peak } (II)\}/6$$

$$B_{mol}=\{\text{Integrated value of peak } (III)-(A_{mol}\times 3)\}/3$$

$$C_{mol}=\{\text{Integrated value of peak } (IV)-(B_{mol}\times 2)\}/4$$

$A_{mol\ \%}$, $B_{mol\ \%}$ and $C_{mol\ \%}$ are calculated from $A_{mol}$, $B_{mol}$ and $C_{mol}$ described above, respectively.

$$A_{mol\ \%}=100\times A_{mol}/(A_{mol}+B_{mol}+C_{mol})$$

$$B_{mol\ \%}=100\times B_{mol}/(A_{mol}+B_{mol}+C_{mol})$$

$$C_{mol\ \%}=100\times C_{mol}/(A_{mol}+B_{mol}+C_{mol})$$

According to the ester compound of the present invention, $A_{mol\ \%}$:$B_{mol\ \%}$:$C_{mol\ \%}$ described above are 25 to 42 mol %: 33 to 55 mol %: 12 to 34 mol %, respectively. The ratio is out of the above range, the extreme pressure performance and wear resistance may be lowered, energy loss due to internal resistance of the lubricant oil itself accompanied by the high viscosity and the resultant reduction of power output may occur, the biodegradability may be deteriorated and low-temperature fluidity may be lowered.

On the viewpoint of the present invention, $A_{mol\ \%}$ may preferably be 27 to 40 mol %, $B_{mol\ \%}$ may preferably be 40 to 53 mol %, and $C_{mol\ \%}$ may preferably be 15 to 30 mol %, respectively.

According to the present invention, $(B_{COOH}+C_{COOH})/A_{OH}$ is calculated using $A_{mol}$, $B_{mol}$ and $C_{mol}$ as follows.

$$B_{COOH}+C_{COOH})/A_{OH}=\{B_{mol}+(C_{mol}\times 2)\}/(A_{mol}\times 3)$$

According to the present invention, the value of $(B_{COOH}+C_{COOH})/A_{OH}$ calculated above is made 0.90 to 1.02. In the case that $(B_{COOH}+C_{COOH})/A_{OH}$ is below 0.90, the wear resistance and stability against oxidation may be deteriorated upon blending an extreme pressure additive. Further, $(B_{COOH}+C_{COOH})/A_{OH}$ is beyond 1.02, the wear resistance may be deteriorated. $(B_{COOH}+C_{COOH})/A_{OH}$ may preferably be 0.92 to 1.01 and more preferably be 0.94 to 1.00.

According to a preferred embodiment, $B_{mol}/A_{mol}$ is 1.0 to 2.0. $B_{mol}/A_{mol}$ is made 1.0 or higher, so that it can be suppressed the energy loss due to internal stress of the lubricant oil itself accompanied with the high viscosity to suppress the reduction of the electric generation capacity. Further, $B_{mol}/A_{mol}$ is made 2.0 or lower, so that the extreme pressure performance of the lubricating oil composition can be further improved. $B_{mol}/A_{mol}$ may preferably be 1.1 to 1.9 and more preferably be 1.2 to 1.8.

According to the ester of the present invention, the value of kinematic viscosity at 40° C. may preferably be 300 to 400 mm$^2$/s. The kinematic viscosity at 40° C. is made 300 mm$^2$/s or higher, so that the extreme pressure performance of the lubricating oil composition can be further improved. Further, the kinematic viscosity at 40° C. is made 400 mm$^2$/s or lower, so that it can be suppressed the energy loss due to internal resistance of the lubricant oil itself accompanied with the high viscosity to suppress the reduction of the electric generation-capacity. The kinematic viscosity at 40° C. of the ester of the present invention is preferably 300 to 400 mm$^2$/s and more preferably 320 to 370 mm$^2$/s.

The ester as the lubricant base oil of the present invention can be produced by known methods including a method of directly reacting (A) trimethylolpropane, (B) the monovalent straight-chain saturated fatty acid and (C) adipic acid, and a synthesizing method of transesterification. Further, after the transesterification, it may optionally applied a removing method such as evaporation under reduced pressure and washing with water after neutralization with an alkali for removing unreacted straight-chain saturated fatty acids or the like.

The lubricating oil composition obtained by esterification of (A) trimethylolpropane, (B) monovalent straight-chain saturated fatty acids and (C) adipic acid may preferably have an acid value of 5.0 mgKOH/g or lower. The acid value of the ester is made 5.0 mgKOH/g or lower, so that the wear resistance and stability against oxidation can be further improved. On the viewpoint, the acid value of the ester may more preferably be made 3.0 mgKOH/g or lower.

The lubricant base oil of the present invention can exhibit excellent stability against oxidation upon using in combination with (D) quinoline derivative. (D) The quinoline derivative includes a polymer of the quinoline derivative. For example, the quinoline derivative includes 2,2,4-trimethyl-1,2-dihydroquinoline or its polymerized product, 6-methoxy-2,2,4-trimethyl 1,2-dihydroquinoline or its polymerized product, 6-ethoxy-2,2,4-trimethyl 1,2-dihydroquinoline or its polymerized product and the like, and one or two or more of them may be used alone or in combination.

(D) Quinoline derivative is generally used as a quinoline-based antioxidant, and it may be used the quinoline derivative available as an antioxidant for a lubricant oil and an anti-aging agent for a rubber, for example. It may be listed. 2,2,4-trimethyl-1,2-dihydroquinoline (TMDQ) or its polymerized product includes "Vanlube RD" supplied by T. R.

Vandervilt, Inc., "NOCRAC 224" supplied by Ouchi Shinko Chemical Industrial Co., Ltd., "ANTAGE RD" supplied by KAWAGUCHI Chemical Co. LTD., "NONFLEX RD" and "NONFLEX QS" supplied by Seiko Chemical Corporation and the like, for example.

Further, 6-methoxy-2,2,4-trimethyl-1,2-dihydroquinoline or its polymerized product includes "NOCRAC AW" and "NOCRAC AW-N" supplied by Ouchi Shinko Chemical Industrial Co., Ltd., "ANTAGE AW" supplied by KAWAGUCHI Chemical Co. LTD., "NONFLEX AW" and "NONFLEX AW-S" supplied by Seiko Chemical Corporation, and the like.

According to the present invention, on the viewpoint of obtaining the lubricant base oil having excellent stability against oxidation, 2,2,4-trimethyl-1,2-dihydroquinoline (TMDQ) or its polymerized product is preferably used.

The blending ratio of (D) the quinoline derivative with respect to 100 mass parts of the lubricant base oil is 0.1 to 5.0 mass parts. In the case that the blending ratio of (D) is lower than 0.1 mass parts, sufficiently high stability against oxidation may not be obtained. Further, in the case that the blending ratio of (D) exceeds 5.0 mass parts, the biodegradability may be deteriorated, as well as precipitates may tend to be generated during heating for a long time. The blending ratio may preferably be 0.5 to 4.0 mass parts and more preferably be 0.7 to 3.0 mass parts.

The lubricant base oil of the present invention provides excellent extreme pressure performance and wear resistance in combination with an extreme pressure additive. As the extreme pressure additive, it may be used known agents used for lubricant oils such as sulfur-based, phosphorus-based, molybdenum-based agents and the like. Although it is not particularly limited, excellent extreme pressure performance and wear resistance can be obtained by using the base oil with the sulfur-based extreme pressure additive.

The sulfur-based extreme pressure additive used in combination with the lubricant base oil of the present invention includes known additives. For example, the agents include sulfide fats and oils, sulfurized fatty acids, sulfide esters, monosulfide or disulfide, sulfoxide compounds, sulfurized olefins, dihydrocarbyl polysulfide, thiocarbamates, dialkyl thiodipropionates, thioterpenes and the like. Further, as the extreme pressure additive, it may be used a compound containing an element, in addition to sulfur, such as phosphorus, zinc, molybdenum or the like in the molecule. Zinc dialkyldithiophosphate or the like is included in the above. The compound may be used alone or two or more compounds may be used in combination.

Further, as the extreme pressure additive, it is commercialized an SP based additive used with the phosphorus-based additive, an SP—Mo based agent used with the phosphorus-based additive and molybdenum-based additive, and heat resistant SP based additive with the hear resistance of the SP based additive improved. As these additives exhibit superior extreme pressure performance, these additives may be used.

As the extreme pressure additive, commercialized products may be used. Further, as such commercialized products, it may be used a package of agents containing the sulfur-based extreme pressure additive. Although it is not particularly limited, the commercialized package of the additives containing the commercialized sulfur-based extreme pressure additive includes "IG93MA", "5060", "5064", "5800" and "5091" supplied by Lubrizol corporation, and "HiTEC 307", "HiTEC 315", "HiTEC 317", "HiTEC 350", "HiTEC 343", "HiTEC 349", "HiTEC 385" and "Axcel S" supplied by Afton Chemical Corporation. According to the present invention, as the package of the agents, "IG93MA", "5060", "5064" and "HiTEC 343" supplied by Lubrizol Corporation may be preferably used.

The blending ratio of the extreme pressure additive to the lubricant base oil of the present invention with respect to 100 mass parts of the lubricant base oil may preferably be 0.1 to 5.0 mass parts. The blending ratio of the extreme pressure additive is made 0.1 mass parts or higher, so that the extreme pressure performance and load-carrying capacity can be further improved. Further, the blending ratio of the extreme pressure additive is made 5.0 mass parts or lower, so that the heat resistance can be improved and the reduction of the biodegradability can be suppressed. The bending ratio may preferably be 0.2 to 4.5 mass parts and more preferably be 0.5 to 4.0 mass parts.

Further, various kinds of additives conventionally used may be blended in the lubricant base oil of the present invention in addition to (D) the quinoline derivative and extreme pressure additive. Such additive to be blended includes an antioxidant, a metal deactivator, a rust prevention agent, an anti-foaming agent, an anti-wear agent, a pour point depressant, a viscosity index improver, a thickener, a detergent, an ashless dispersant and the like.

The lubricating oil composition of the present invention can be produced by blending predetermined amounts of (D) quinoline derivative and extreme pressure additive to the lubricant base oil and optionally blending various kinds of additives described above. As to the blending ratios, and mixing and adding methods of the respective additives are not particularly limited, and various kinds of methods may be applied. The orders of the blending, mixing and adding are not also limited, and various kinds of methods may be applied. For example, various kinds of the additives may be directly added to the lubricant base oil and then mixed by heating, or solutions of the additives at high concentrations may be prepared in advance and the solutions are then mixed with the base oil.

EXAMPLES

The present invention will be described further in detail below, referring to the following inventive and comparative examples.

Inventive Examples 1 to 4: Comparative Examples 1 to 6

(Synthesis of Lubricant Base Oils of I to X)

Into a four-necked flask of 5 liters equipped with a thermometer, a tube for introducing nitrogen, agitator and air-cooling tube, predetermined amounts of trimethylolpropane (TMP) supplied by NOF corporation, "NAA-82" (Caprylic acid for industrial use having a content of caprylic acid of 99 percent), "NAA-102" (capric acid for industrial use having a content of capric acid of 99 percent), "NAA-122" (lauric acid for industrial use having a content of lauric acid of 99 percent) were charged. They were reacted under nitrogen flow at 240° C. at ambient pressure while the water generated by the reaction was evaporated.

As to the lubricant base oils I to X obtained as described above, the molar percentage of each component was analyzed using $^{1}H$ NMR. Further, as to the composition of (B) monovalent straight-chain saturated fatty acid, the molar percentage of each component was measured by gas chromatography. The results of the measurement was shown in tables 1 and 2.

(Acid Value)

It was measured according to Japanese Industrial Standards JIS K0070.

(Kinematic Viscosity at 40° C.)

It was measured according to Japanese Industrial Standards JIS K 2283

(Pour Point)

It was measured according to Japanese Industrial Standards JIS K 2269 at an interval of 1° C.

(Test of Wear Resistance and Load-Carrying Capacity)

As to the lubricant base oils I to X, for evaluating the extreme pressure performance upon adding the extreme pressure additive, 1.2 mass parts of "HiTEC 343" (supplied by Afton Chemical Corporation; package of additives containing sulfurized olefin for gear oil) (extreme pressure additive E-1) was added to 100 mass parts of the lubricant base oil, followed by the following tests. The results of the measurement were shown in tables 1 and 2.

(Shell Four-Ball Wear Test)

Using a high-speed Shell four-ball testing machine, wear scar diameter (μm) was measured according to ASTM D4172. As the wear scar diameter (μm) is smaller, the wear resistance is better.

(Shell Four-Ball Load-Carrying Capacity Test)

Using a high-speed Shell four-ball testing machine, the maximum anti-seizure load was measured according to ASTM D1783. As the maximum anti-seizure load is larger, the extreme pressure performance is better.

(Biodegradation Test)

Biodegradation test was performed according to OECD301 F. In the case that the biodegradability measured by the test is 60 percent or higher, it is satisfied standards as a biodegradable lubricant oil according to ECO MARK OFFICE of Public Interest Incorporated foundation "Japan Environment Association". According to this test, it is qualified in the case that the biodegradability is 60 percent or higher and disqualified in the case that biodegradability is below 60 percent.

TABLE 1

| Inventive Examples | | 1 | 2 | 3 | 4 |
|---|---|---|---|---|---|
| | Lubricant base oil | I | II | III | IV |
| | $A_{mol\ \%}$ (mol %) | 30.3 | 30.4 | 30.3 | 31.7 |
| | $B_{mol\ \%}$ (mol %) | 49.0 | 48.8 | 49.0 | 48.0 |
| | $C_{mol\ \%}$ (mol %) | 20.7 | 20.7 | 20.7 | 20.3 |
| | $B_{mol}/A_{mol}$ | 1.62 | 1.60 | 1.61 | 1.51 |
| | Molar percentage (mol %) of component derived from lauric acid in (B) | 25.2 | 7.0 | 44.0 | 24.8 |
| | Molar percentage (mol %) of component derived from capric acid in (B) | 28.9 | 38.0 | 22.6 | 28.9 |
| | Molar percentage (mol %) of component derived from caprylic acid in (B) | 45.9 | 55.1 | 33.3 | 46.3 |
| | $(B_{COOH} + C_{COOH})/A_{OH}$ | 0.99 | 0.99 | 0.99 | 0.93 |
| Evaluation of property | Acid value (mgKOH/g) | 2.6 | 2.7 | 2.8 | 1.9 |
| | Kinematic viscosity at 40° C. (mm2/s) | 323 | 325 | 330 | 301 |
| | Pour point (° C.) | −38 | −41 | −25 | −37 |
| Tests of wear resistance and load-carrying capacity | Shell four-ball wear test (wear scar diameter (μm) | 310 | 420 | 305 | 350 |
| | Shell four-ball load-carrying capacity test (maximum anti-seizure load: kg) | 126 | 100 | 126 | 100 |
| | Biodegradability test | Qualified | Qualified | Qualified | Qualified |

TABLE 2

| | | Comparative Examples | | | | | |
|---|---|---|---|---|---|---|---|
| | | 1 | 2 | 3 | 4 | 5 | 6 |
| | Lubricant base oil | V | VI | VII | VIII | IX | X |
| | $A_{mol\%}$ (mol %) | 30.4 | 30.3 | 33.3 | 28.9 | 28.5 | 37.0 |
| | $B_{mol\%}$ (mol %) | 48.8 | 49.0 | 46.4 | 51.4 | 61.5 | 25.2 |
| | $C_{mol\%}$ (mol %) | 20.7 | 20.7 | 20.3 | 19.7 | 10.0 | 37.8 |
| | $B_{mol}/A_{mol}$ | 1.60 | 1.61 | 1.39 | 1.78 | 2.16 | 0.68 |
| | Molar percentage (mol %) of component derived from lauric acid in (B) | 0.0 | 57.2 | 24.8 | 25.1 | 25.3 | 25.2 |
| | Molar percentage (mol %) of component derived from capric acid in (B) | 40.5 | 17.6 | 29.2 | 29.1 | 28.8 | 29.0 |
| | Molar percentage (mol %) of component derived from caprylic acid in (B) | 59.5 | 25.2 | 46.0 | 45.7 | 45.9 | 45.8 |
| | $(B_{COOH} + C_{COOH})/A_{OH}$ | 0.99 | 0.99 | 0.87 | 1.05 | 0.95 | 0.91 |
| Evaluation of property | Acid value (mgKOH/g) | 2.4 | 2.9 | 0.8 | 6.0 | 2.0 | 1.5 |
| | Kinematic viscosity at 40° C. (mm2/s) | 329 | 355 | 321 | 305 | 43 | 4110 |
| | Pour point (° C.) | −45 | −10 | −35 | −40 | −15 | −25 |
| Tests of wear resistance and load-carrying capacity | Shell four-ball wear test | 650 | 400 | 590 | 620 | 661 | 305 |
| | Shell four-ball load-carrying capacity test (maximum anti-seizure load: kg) | 80 | 126 | 80 | 80 | 64 | 126 |
| | Biodegradability test | Qualified | Qualified | Qualified | Qualified | Qualified | Disqualified |

As shown in table 1, it is proved that the lubricant base oils I to IV have excellent biodegradability, good low-temperature fluidity and excellent extreme pressure performance upon adding an extreme pressure additive.

On the other hand, as shown in table 2, according to the comparative example 1, the molar percentage of the component derived from lauric acid in (B) is low, so that the extreme pressure performance is deteriorated.

According to the comparative example 2, the molar percentage of the component described from lauric acid in (B) is high, so that the pour point is high and the low-temperature fluidity is low.

According to the comparative example 3, the value $(B_{COOH}+C_{COOH})/A_{OH}$ is low, so that the extreme pressure performance is deteriorated.

According to the comparative example 4, $(B_{COOH}+C_{COOH})/A_{OH}$ is high, so that the extreme pressure performance is deteriorated.

According to the comparative example 5, the molar percentage $B_{mol\ \%}$ of (B) component derived from the monovalent straight-chain saturated fatty acid having a carbon number of 8 to 12 is high and the molar percentage $C_{mol\ \%}$ of (C) component derived from adipic acid is low, so that the fluidity at low temperature is low and extreme pressure performance is deteriorated.

According to the comparative example 6, the molar percentage $B_{mol\ \%}$ of (B) component derived from the monovalent straight-chain saturated fatty acid having a carbon number of 8 to 12 is low and the molar percentage $C_{mol\ \%}$ of (C) component derived from adipic acid is high, so that the biodegradability was disqualified.

Inventive Examples 5 to 11

As to the lubricant base oils I to IV prepared as described above, the following additives were blended to prepare lubricating oil compositions.

(Preparation of Lubricating Oil Composition)

In a four-necked flask of 5 liters equipped with a thermometer, tube for introducing nitrogen, agitator and a Dimroth condenser, the following additives were added to each of the ester base oils I to IV synthesized as described above in blending ratios described in table 3. The agitation and mixing were performed at 80° C. for 1 hour. After the mixing, the pressure was reduced at 150° C. and 50 mmHg for 2 hours to prepare the respective lubricating oil compositions of the inventive examples 5 to 11 listed in table 3.

(Antioxidant D-1)

"Vanlube RD" (supplied by R. T. Vandervilt, Inc.: polymerized product of 2,2,4-trimethyl-1,2-dihydroquinoline)

(Antioxidant D-2)

"NONFLEX AW" (supplied by Seiko Chemical Corporation; 6-ethoxy-2,2,4-trimethyl-1,2-dihydroquinoline)

(Extreme Pressure Additive E-1)

"HiTEC 343" (supplied by Afton Chemical Corporation; package of additives containing sulfurized olefin for gear oil)

(Extreme Pressure Additive E 2)

"Lubrizol 5060" (supplied by Lubrizol corporation: SP-based additive package for gear oil)

(Extreme Pressure Additive E-3)

"Lubrizol 5064" (supplied by Lubrizol corporation: SP-based additive package for gear oil)

(Extreme Pressure Additive E 4)

"Lubrizol IG93MA" (supplied by Lubrizol corporation: SP-based additive package for gear oil)

(Common Additives)

As the common additive components other than the additives (D-1), (D-2), (E-1), (E-2), (E-3) and (E-4), the following compounds were blended in a total amount of L1.02 mass percent.

Dibutylhydroxytoluene (BHT): 0.3 mass percent

N,N-bis (2-ethylhexyl)-(4 or 5) -methyl-1H-benzotriazol-1-methylamine (Metal deactivator: "Irgamet 39" supplied by BASF corporation): 0.05 mass percent (Evaluation of Lubricating Oil Composition)

The thus prepared lubricating oil composition was subjected to the following evaluations and the results were shown in table 3.

(RPVOT Test)

Oxidation Stability Test of Lubricating oil (RPVOT) was preformed according to Japanese industrial standards (JIS K2514-3 (2013)). Numerical values shown in table 3 indicate time periods (minutes) required for the reduction of the pressure from the maximum pressure by 175 kPa. As the numerical value is larger, the oxidation stability is higher.

(Shell Four-Ball Wear Test)

Using a high-speed Shell four-ball testing machine, wear scar diameter (μm) was measured according to ASTM D4172. As the wear scar diameter (μm) is smaller, the wear resistance is better.

(Shell Four-Ball Load-Carrying Capacity Test)

Using a high-speed Shell four-ball testing machine, the maximum anti-seizure load was measured according to ASTM D1783. As the maximum anti-seizure load is larger, the extreme pressure performance is better.

(Rust-Prevention Performance Test)

The rust-prevention performance test of a lubricant oil (Artificial sea water) was performed according to Japanese Industrial Standards JIS K 2510. Although the above test is conventionally completed in 24 hours, the present test was continued for two weeks and the results of the rust-prevention performance was evaluated after the two weeks.

(Thermal Stability Test)

The thermal stability test of a lubricant oil is performed using a turntable testing machine according to Japanese Industrial Standards JIS K2540 at 170° C. for 24 hours. According to the test, in the case that precipitates and sludge was not generated, it is described "no sludge" in the table, indicating that the thermal stability is high. On the other hand, in the case that the precipitate or sludge is generated, it was described "presence of sludge" in table 3, indicating that the thermal stability is low.

(Flash Point)

Flash point was measured using Cleveland open-cup tester according to Japanese industrial Standards JIS K 2565. As the flash point is higher in the test, the flame retardant property is better.

(Foaminess/Foam Stability Test)

It was measured at sequence I (24° C.) according to Japanese Industrial Standards JIS K2518. As the numerical value is smaller, the foaminess is inferior and defoaming property is higher.

(Biodegradability Test)

Biodegradation test was performed according to OECD 301 F. In the case that the biodegradability measured by the test is 60 percent or higher, it is qualified as a biodegradable lubricant oil according to the standards of ECO MARK OFFICE of Public Interest Incorporated foundation "Japan Environment Association". According to this test, it is qualified in the case that the biodegradability is 60 percent or higher and disqualified in the case that biodegradability is below 60 percent.

TABLE 3

| | Inventive Examples | 5 | 6 | 7 | 8 |
|---|---|---|---|---|---|
| Blend composition (masss %) | Lubricant base oil | (I) 100 | (II) 100 | (III) 100 | (IV) 100 |
| | Antioxidant D-1 | 1.2 | 1.2 | 1.2 | 1.2 |
| | Extreme pressure agent E-1 | 2.0 | 2.0 | 2.0 | 2.0 |
| | Extreme pressure agent E-2 | — | — | — | — |
| | Extreme pressure agent E-3 | — | — | — | — |
| | Extreme pressure agent E-4 | — | — | — | — |
| | Common additives | 0.35 | 0.35 | 0.35 | 0.35 |
| Evaluation Results | RPVOT test (minutes) | 565 | 545 | 555 | 530 |
| | Shell four-ball wear test (wear scar diameter (μm)) | 315 | 430 | 313 | 338 |
| | Shell four-ball load-carrying capacity test (maximum anti-seizure load: kg) | 126 | 100 | 126 | 100 |
| | Rust-prevention performance test (Artificial sea water: 2 week) | No rust | No rust | No rust | No rust |
| | Thermal stability test | No sludge | No sludge | No sludge | No sludge |
| | Flash point (° C.) | 298 | 286 | 308 | 278 |
| | (Foaminess/Foam stability test (ml/ml) | 0/0 | 0/0 | 0/0 | 0/0 |
| | Pour point (° C.) | −40 | −40 | −28 | −37 |
| | Biodegradability test | Qualified | Qualified | Qualified | Qualified |

| | Inventive Examples | 9 | 10 | 11 |
|---|---|---|---|---|
| Blend composition (masss %) | Lubricant base oil | (I) 100 | (II) 100 | (III) 100 |
| | Antioxidant D-1 | — | 1.2 | 1.2 |
| | Antioxidant D-2 | 2.0 | — | — |
| | Extreme pressure agent E-2 | 2.5 | — | — |
| | Extreme pressure agent E-3 | — | 5.0 | — |
| | Extreme pressure agent E-4 | — | — | 3.0 |
| | Common additives | 0.35 | 0.35 | 0.35 |
| Evaluation Results | RPVOT test (minutes) | 510 | 560 | 555 |
| | Shell four-ball wear test (wear scar diameter (μm)) | 370 | 315 | 377 |
| | Shell four-ball load carrying capacity test (maximum anti-seizure load: kg) | 100 | 100 | 126 |
| | Rust-prevention performance test (Artificial sea water: 2 week) | No rust | No rust | No rust |
| | Thermal stability test | No sludge | No sludge | No sludge |
| | Flash point (° C.) | 302 | 278 | 290 |
| | (Foaminess/Foam stability test (ml/ml) | 0/0 | 10/0 | 5/0 |
| | Pour point (° C.) | −38 | −38 | −28 |
| | Biodegradability test | Qualified | Qualified | Qualified |

As described in the inventive examples 5 to 11 shown in tables 1 to 3, it is proved that the lubricating oil compositions I to IV within the scope of claims have excellent biodegradability, excellent low-temperature fluidity, excellent extreme pressure performance, high oxidation stability and high thermal stability upon blending various kinds of additives.

INDUSTRIAL APPLICABILITY

The lubricant base oil of the present invention has excellent biodegradability, excellent low-temperature fluidity, and excellent extreme pressure performance upon blending an extreme pressure additive. The base oil is thus suitable for a base oil for a gear oil or the like and may particularly preferably used in a speed increaser of a wind turbine generation system. Even in the case that the base oil is leaked out, the base oil has excellent biodegradability to reduce the load, onto the environment.

The invention claimed is:

1. A gear oil comprising an ester, said ester comprising:

a component (A) derived from trimethylolpropane in a molar percentage $A_{mol\ \%}$ of 25 to 42 mol %;

components (B) derived from monovalent straight-chain saturated fatty acids each having a carbon number of 8 to 12 in a molar percentage $B_{mol\ \%}$ of 33 to 55 mol %: and a component (C) derived from adipic acid in a molar ratio $C_{mol\ \%}$of 15 to 30 mol %, wherein said components (B) derived from said monovalent straight-chain saturated fatty acids each having a carbon number of 8 to 12 comprise a component derived from lauric acid in a molar percentage of 5 to 50 mol %, and wherein $(B_{COOH}+C_{COOH}/A_{OH}$ is 0.90 to 1.02, in the above formula:

$A_{OH}$ represents a hydroxyl equivalent of said component (A) derived from trimethylolpropane, $B_{COOH}$ represents a carboxyl group equivalent of said components (B) derived from said monovalent straight-chain saturated fatty acids each having a carbon number of 8 to 12, and $C_{COOH}$ represents a carboxyl group equivalent of said component (C) derived from adipic acid.

2. A gear oil composition comprising:

100 mass percent of said gear oil of claim 1; and 0.1 to 3.0 mass percent of (D) a quinoline derivative.

3. The gear oil as claimed in claim 1, wherein said monovalent straight-chain saturated fatty acids consist of lauric acid, caprylic acid, and pelargonic acid, or consist of lauric acid, caprylic acid and capric acid, or consist of lauric acid, caprylic acid and undecylic acid.

4. The gear oil as claimed in claim 1, wherein said molar percentage $A_{mol\ \%}$ of said component (A) derived from trimethylolpropane is 27 to 40 mol %.

5. The gear oil as claimed in claim 1, wherein said molar percentage $B_{mol\ \%}$ of said components (B) derived from said monovalent straight-chain saturated fatty acids is 40 to 53 mol %.

6. The gear oil as claimed in claim 1, adapted for use in a wind turbine generator system.

7. A gear oil composition comprising:

100 mass percent of the gear oil as claimed in claim 1; and an extreme pressure additive in a ratio of 0.1 to 5.0 mass parts.

8. The gear oil composition as claimed in claim 7, further comprising 0.1 to 5.0 mass percent of (D) a quinoline derivative.

* * * * *